United States Patent [19]

Soleri

[11] 4,050,339

[45] Sept. 27, 1977

[54] AUTOMATIC CAROUSEL-TYPE MEAT CUTTING MACHINE

[76] Inventor: Richard A. Soleri, 5614 N. Rock Creek Road, Agoura, Calif. 91301

[21] Appl. No.: 647,320

[22] Filed: Jan. 7, 1976

[51] Int. Cl.[2] ..... B26D 4/50

[52] U.S. Cl. ..... 83/703; 83/409.1; 83/411 A; 83/818; 214/151

[58] Field of Search ..... 83/411 A, 703, 409.1, 83/409.2, 818; 214/151, 1 R; 198/210

[56] References Cited

U.S. PATENT DOCUMENTS

| | | | |
|---|---|---|---|
| 73,343 | 1/1868 | Keith | 83/409.2 X |
| 861,171 | 7/1907 | Girtman | 83/409.2 |
| 1,054,524 | 2/1913 | Fosdick | 83/409.2 |
| 2,969,815 | 1/1961 | Lasar | 83/818 |
| 3,291,168 | 12/1966 | Zitner | 83/411 A X |
| 3,640,166 | 2/1972 | Michals et al. | 83/411 A X |
| 3,889,567 | 6/1975 | Sato et al. | 83/818 |

FOREIGN PATENT DOCUMENTS

| | | | |
|---|---|---|---|
| 1,279,262 | 11/1961 | France | 83/411 A |
| 6,512 | 5/1970 | Japan | 83/411 A |

*Primary Examiner*—Frank T. Yost

*Attorney, Agent, or Firm*—William R. Piper

[57] ABSTRACT

An automatic carousel-type meat cutting machine in which slabs of meat are placed between pairs of rotating jaws that move around a center vertical axis. One jaw in each pair of jaws is spring-biased for gripping the meat, but the weight of the meat will cause it to move downwardly by gravity and rest on a meat-supporting horizontal and stationary platform. A section of the platform is made vertically adjustable with respect to the stationary part and may be adjusted to determine the thickness of the slices of meat cut from the slabs of meat. The stationary and adjustable sections form a complete circle and they support the slabs of meat which are moved by the pairs of meat guiding pairs of jaws. A horizontal portion of an endless band saw lies flush with the plane of the horizontal fixed platform section and the adjustable platform section is positioned therebelow to determine the thickness of the slice. The rotating carousel moves the pairs of jaws with their meat slabs over the adjustable platform section and past the band saw which severs a slice of meat from each slab just prior to the slab being moved onto the fixed platform section.

5 Claims, 13 Drawing Figures

FIG-6-A

AUTOMATIC CAROUSEL-TYPE MEAT CUTTING MACHINE

SUMMARY OF THE INVENTION

An object of my invention is to provide an automatic carousel-type meat cutting machine that includes a unique meat holding and moving carousel in which pairs of jaws receive and guide different sizes and shapes of meat slabs without any manual adjustment and moves these slabs past a band saw that cuts the meat into slices. The weight of the meat slabs causes them to be supported by the horizontal platforms as the pairs of jaws move the slabs in a uniform motion past the horizontal portion of the band saw which results in accurate and even meat cuts or slices. The carousel has radially extending arms, each arm supporting a pair of meat-gripping and guiding jaws. These arms are removably connected to a central hub of the carousel so that arms with the desired sized meat engaging jaws can be used. Smaller cuts of meat will allow more meat gripping jaws to be used in the carousel. This will provide more cuts of meat for each revolution of the carousel.

BRIEF DESCRIPTION OF THE DRAWINGS

FIG. 6A is a schematic view showing the meat cutting principle employed by the machine and is taken along the section line 6A—6A in FIG. 6.

FIG. 7 is taken when looking downwardly in the direction of the arrows 7—7 in FIG. 2.

DESCRIPTION OF THE PREFERRED EMBODIMENT

Figure 1:
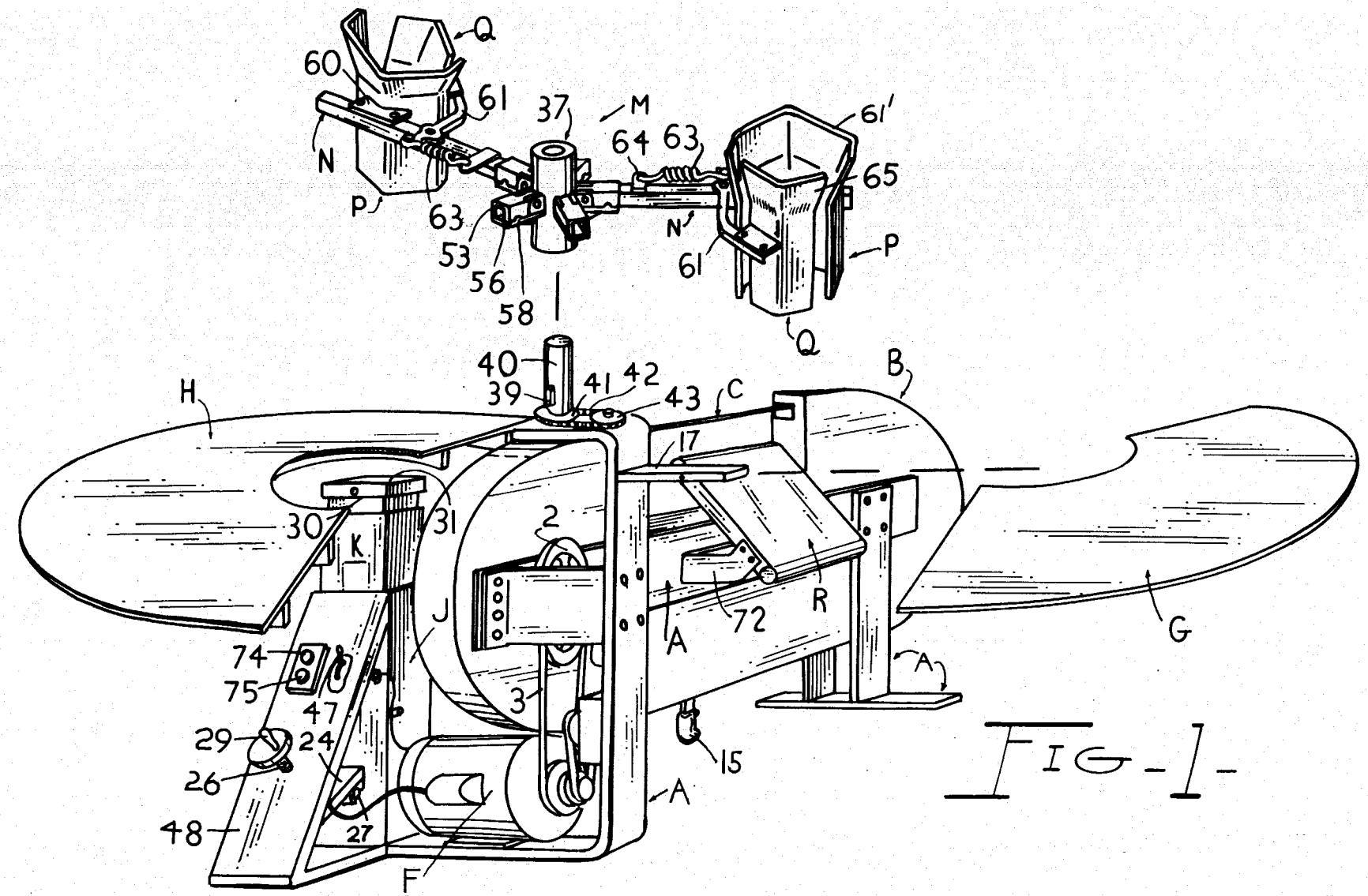
FIG. 1 is an exploded perspective view of the meat cutting machine.

In carrying out my invention I provide a meat cutting machine that includes a frame, indicated generally at A, and a housing B, for an endless bandsaw C, see FIG. 1. The bandsaw housing has rounded ends with a recess 1 in its upper horizontal portion across which the upper reach 2 of the bandsaw extends and it travels along a horizontal plane, see FIGS. 2 and 11. I will first describe how the endless bandsaw is mounted and operated by a motor before setting forth how the bulk meat is cut into slices.

Figure 2:
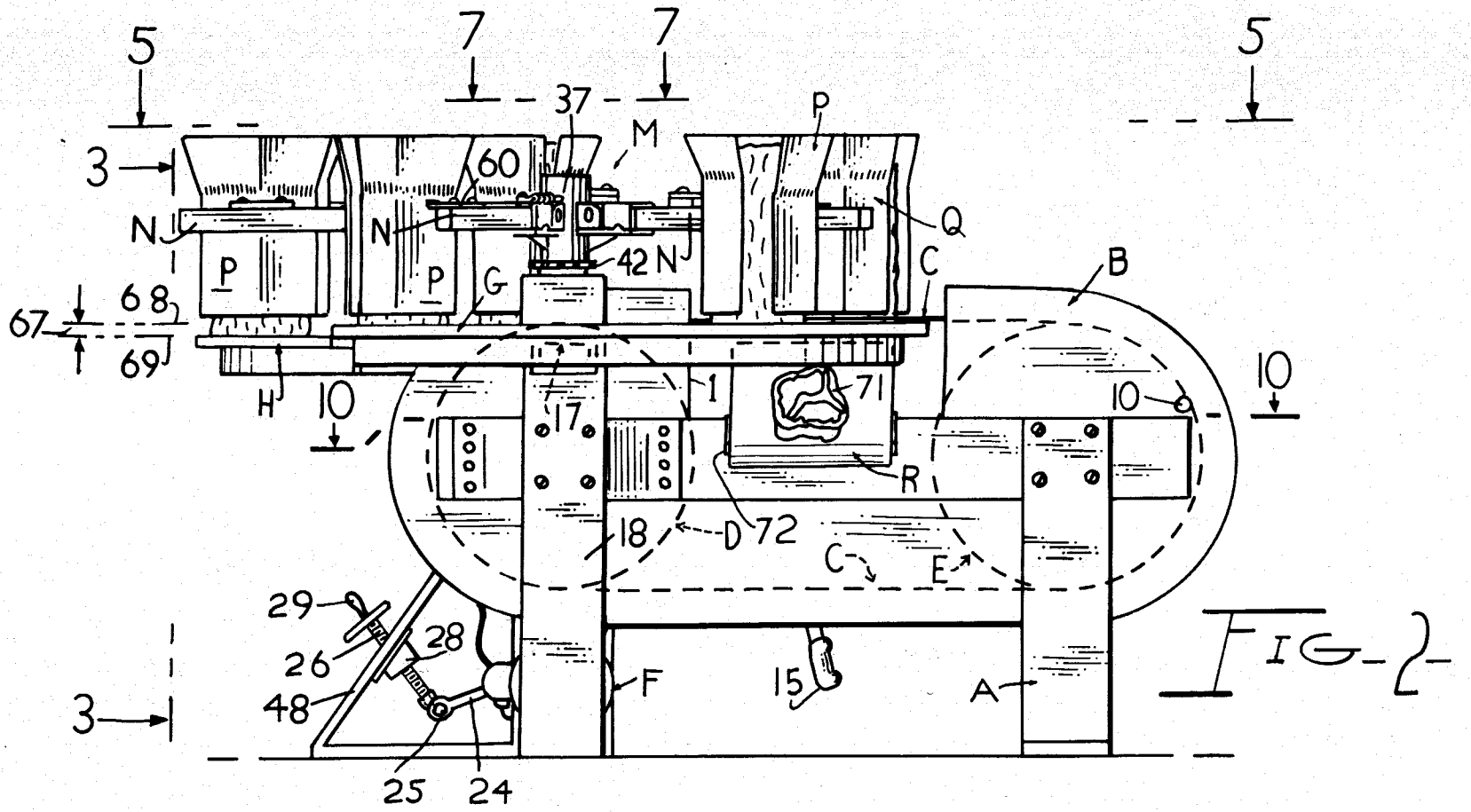
FIG. 2 is a side elevation of the machine.

FIG. 2 illustrates the endless bandsaw C, by dash lines, the saw blade being passed around a drive wheel D, and an adjustable driven wheel E. In FIG. 1, I show an electric motor F, connected to a pulley 2 by a belt 3. Then in FIG. 10, the pulley 2 is mounted on a shaft 4 and the drive wheel D, is keyed to this shaft and is enclosed in the bandsaw housing B. The driven or idler wheel E, is spring biased so as to constantly apply the proper tension on the endless bandsaw C, at all times. In addition the driven wheel E can be moved to free the bandsaw portion engaging it or for mounting a new bandsaw in case the old one becomes dull or breaks.

Figures 7, 8, 9, 10, 11, 12:
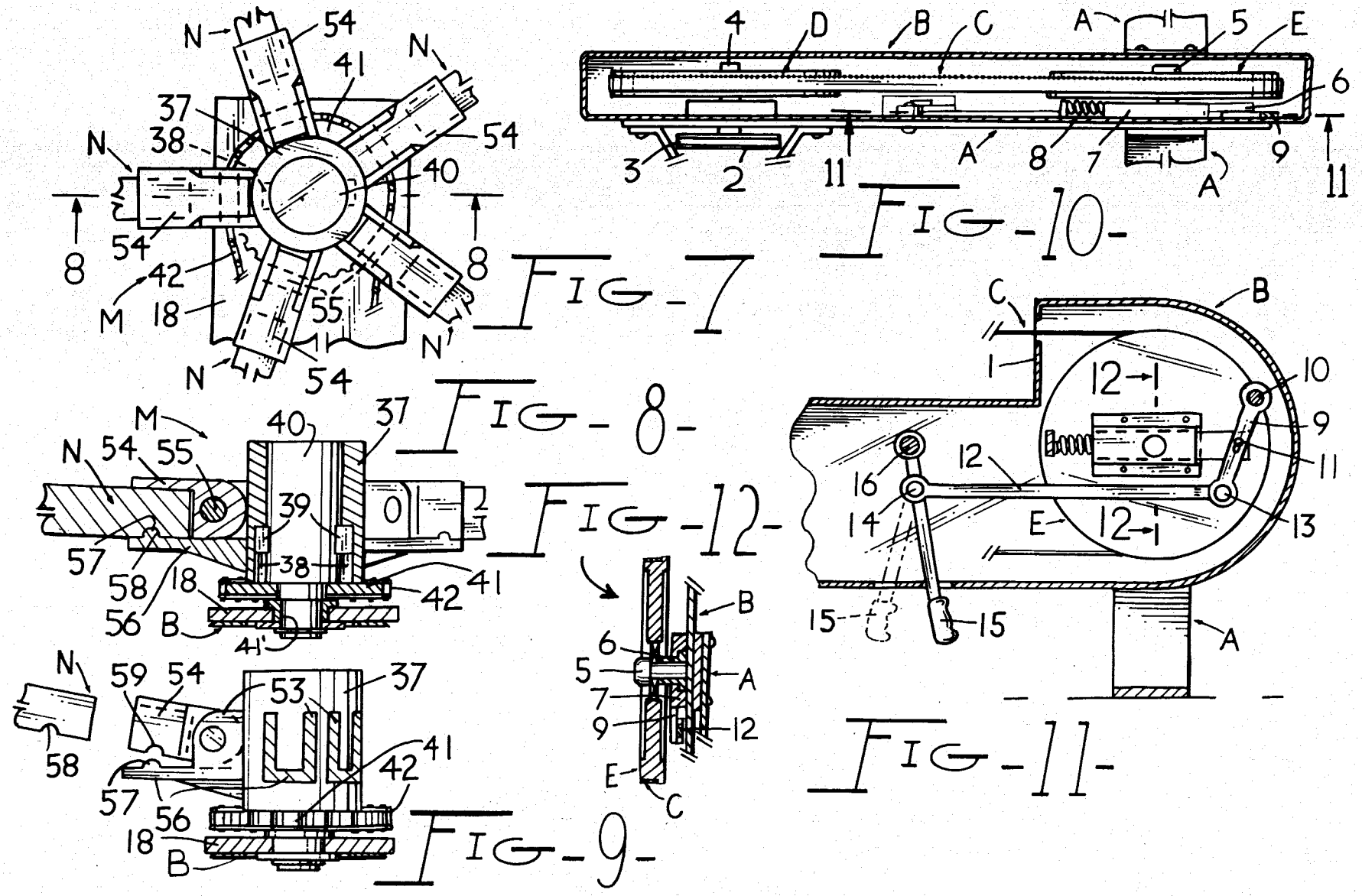
FIG. 7 is an enlarged top view of the central portion of the carousel that carries the meat engaging jaws, not shown in this Figure.
FIG. 8 is a vertical section through the central portion of the carousel and is taken along the line 8—8 of FIG. 7.
FIG. 9 is a view somewhat similar to FIG. 8 and illustrates how the jaw-carrying arms may be removed from the carousel hub.
FIG. 10 is a horizontal longitudinal section through the band saw housing of the machine and it is taken along the line 10—10 of FIG. 2.
FIG. 11 is a vertical longitudinal section through a portion of the band saw housing and it is taken along the line 11—11 of FIG. 10.
FIG. 12 is a vertical transverse section through a portion of the machine and it is taken along the line 12—12 of FIG. 11.

FIGS. 10, 11 and 12 illustrate the adjustable spring biased bandsaw receiving wheel E. The shaft 5 on which the wheel E freely revolves, is carried by a member 6 that is slidably received in a horizontal guide 7 which positioned within the bandsaw housing and is secured to one wall thereof. A compression spring 8 yieldingly urges the member 6 to the right in FIG. 11, and with it the shaft 5 and the wheel E so that the wheel will exert a continuing yielding force in maintaining the bandsaw C taught at all times.

I provide manually operated means for moving the wheel E to the left in FIG. 11 when the operator wishes to inspect the bandsaw or to substitute a new one for a dull or broken bandsaw. An arm 9 is pivotally mounted within the bandsaw housing B, at 10 and it is also pivotally connected to the member 6 at 11. A link 12 has one end pivoted to the arm at 13 and its other end is pivoted at 14 to a hand operated lever 15 which in turn is pivotally connected at 16 to a wall of the bandsaw housing. When the hand lever 15 is in the full line position shown in FIG. 11, the compression spring 8 will yieldingly urge the member 6 and wheel E to the right to maintain a constant yielding pressure on the endless bandsaw C. When the lever 15 is swung to the left into the dot-dash line position, the link 12 and arm 9 will be moved and will move the member 6 and wheel E to the left to free the bandsaw from the wheel. The arm 9 has a slot in which the pivot pin slides during the swinging of the hand lever 15. The freeing of the bandsaw C from the wheel E permits the bandsaw to be removed from both wheels D, and E, and a new bandsaw substituted.

I will now describe the stationary horizontal platform and the vertically adjustable horizontal platform for supporting the bulk meat items which are to be cut into slices as these bulk meat items are moved in a circular horizontal path by a carousel over both platforms so that each item of bulk meat will have a slice cut therefrom as it is moved past the upper horizontal reach of the bandsaw. After the structure of the carousel with its bulk meat engaging pairs of jaws will be described.

Figures 5, 6:
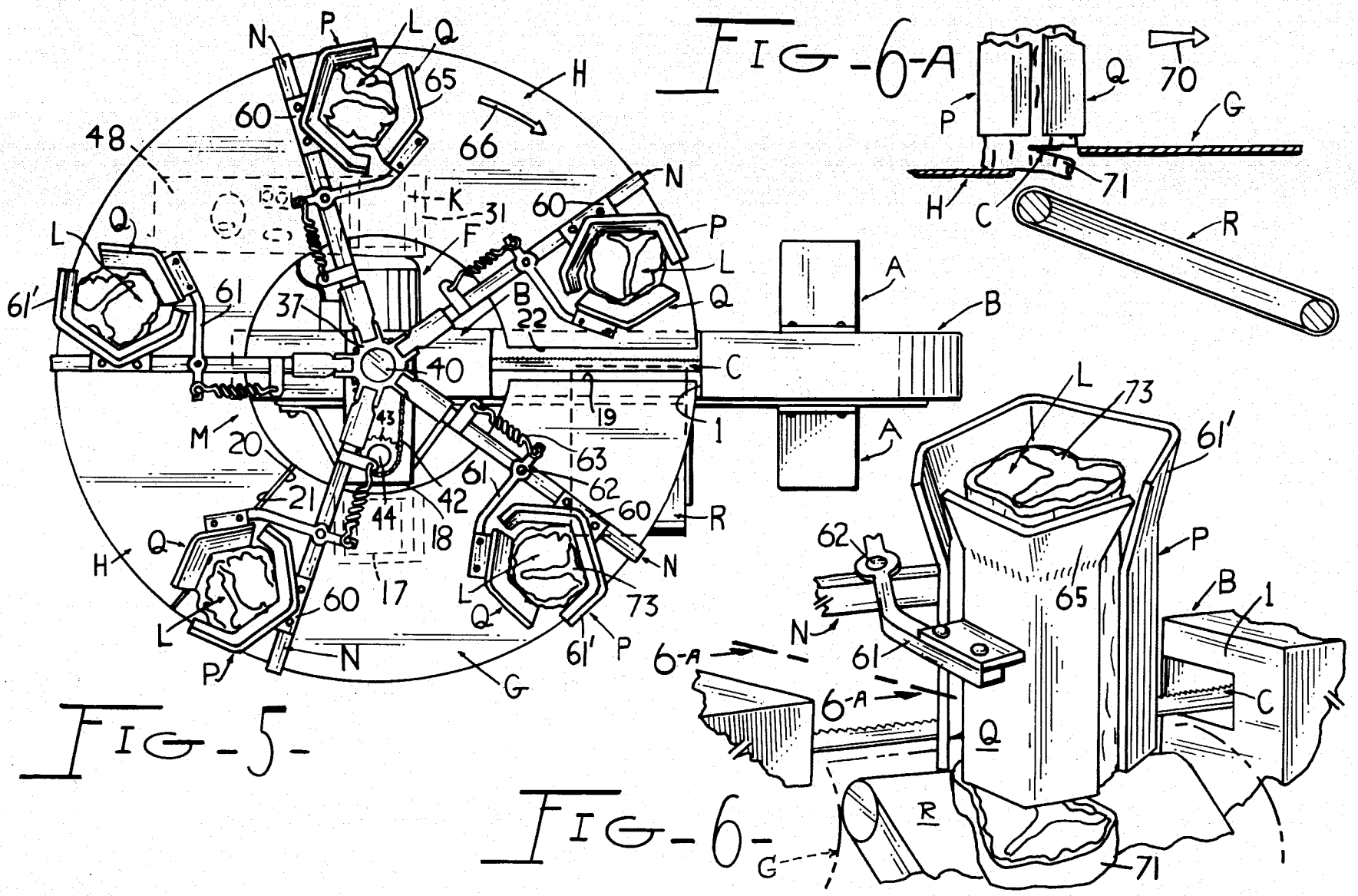
FIG. 5 is a top plan view of FIG. 2 as shown by the arrows 5—5 in that Figure.
FIG. 6 is an enlarged perspective view of a portion of the machine illustrating the relation of a pair of meat engaging jaws as they move the meat slab past the horizontal portion of a band saw for causing the latter to cut a slice from the meat.

FIG. 1 illustrates the horizontal stationary platform G, and the vertically adjustable horizontal platform H, about ready to be attached to the machine. The stationary platform G, is in the shape of an arcuate sector and it is attachable to the horizontal supporting member 17 that in turn projects from an upright 18 of the main frame A. FIG. 2 shows a side elevation and FIG. 5 shows a plan view of the platform G when actually mounted on the support 17. The radial edge 19 of the platform G, is disposed adjacent to the upper horizontal reach of the bandsaw C, and the other radial edge 20 is disposed adjacent to the radial edge 21 of the adjustable platform H when the latter is mounted on the machine in a manner which will be described shortly. Also note from FIG. 5 that the radial edge 22 of the arcuate-shaped platform H, is placed close to the bandsaw and that both platforms form a complete circular support for the bulk meat items that are moved over the two platforms during the cutting of the meat into slices. The platforms support the meat items.

Figure 4:
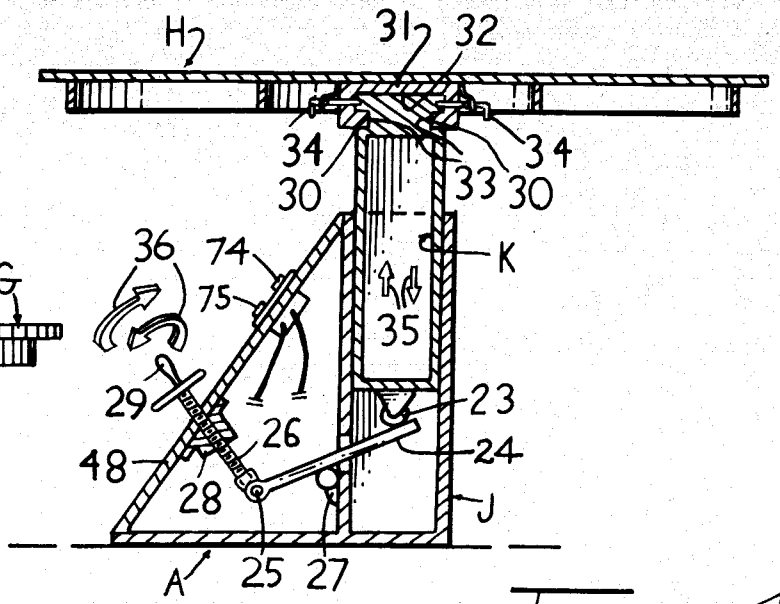
FIG. 4 is a vertical longitudinal section taken along the line 4—4 of FIG. 3 and illustrates a mechanism for raising or lowering the adjustable platform.
Figure 3:
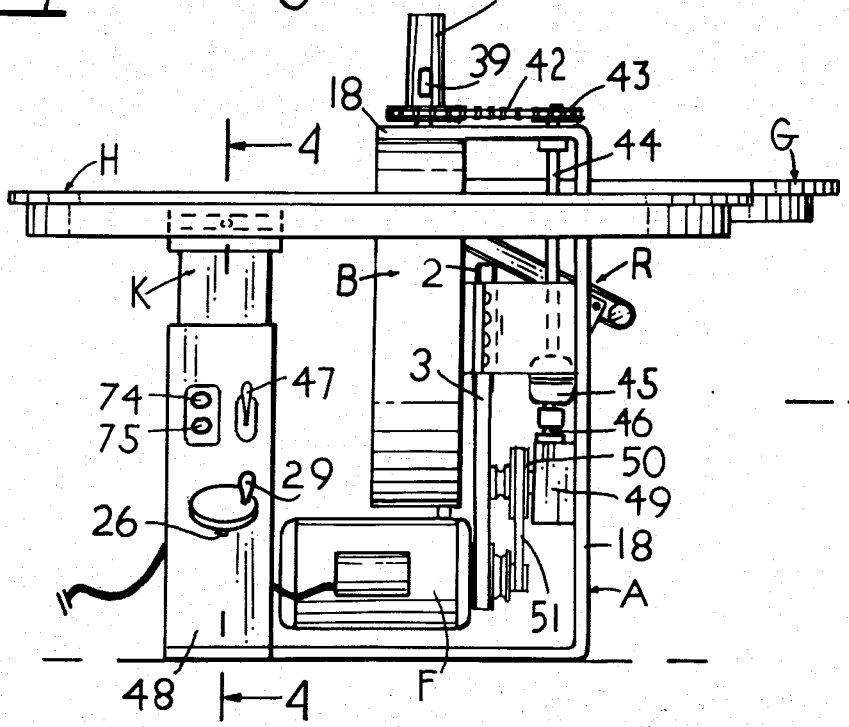
FIG. 3 is an end view of the machine when looking at the left-hand end of FIG. 2 as indicated by the arrows 3—3 in that Figure.

FIGS. 1, 3 and 4 illustrate the vertically movable support for the adjustable platform H. The frame A has a vertically extending hollow casing J that is non-circular in horizontal cross section and is open at its top, see the vertical section of FIG. 4 and the dotted plan view in FIG. 5. A vertically movable member K, of the same cross sectional shape as the horizontal inner area of the casing J, is slidably mounted in the casing J. I show means for raising or lowering the member K, in the casing and this includes a roller 23 mounted at the bottom of the member K, and resting on an arm 24 which in turn is operatively connected at 25 to the lower end of a screw shaft 26. The arm 24 fulcrums on a roller 27 and it extends through an opening in the casing and underlies the roller 23. The screw shaft 26 is received in a threaded bearing 28 and the upper end of the shaft has a handle 29, see also FIG. 3, by means of which the screw shaft 26 may be rotated for raising or lowering the member K. The screw shaft 26 could be operated by a reversible electric motor, not shown, and controlled by a switch, not shown. I show one operative mechanism for raising and lowering the member K.

The vertically adjustable platform H, is removably secured and supported by the top of the member K. In FIG. 4, the top of the member K is shown with a pair of spaced apart and horizontally arranged grooves 30. The underside of the adjustable platform H, has a supporting member 31 with a recess slidably receiving the top of the member K, and this supporting member has inwardly extending flanges 33 arranged on opposite sides of the recess 32 and slidably received in the grooves 30. Spring biased pins 34, carried by the member 31, enter aligned openings in the top of the member K when the adjustable platform is mounted in its proper position on the member K.

The top plan view of the machine shown in FIG. 5, illustrates the proper position of the vertically adjustable platform H when it is secured to the top of the member K, and is supported by it. As already stated, the two arcuate shaped platforms G and H provide a complete circular support for the bulk meat items L as they are moved in a circular path over the platforms by the carousel which in turn will successively move the bulk meat items past the upper reach of the bandsaw blade C for cutting slices from the bulk meat. The member K can be moved vertically in an up and down direction, as indicated by the arrows 35 in FIG. 4, when the screw shaft 26 is rotated in either one of two directions by the handle 29, as shown by the arcuate arrows 36. FIGS. 2 and 3, and the schematic showing of FIG. 6A, illustrate the position of the adjustable platform H, as being slightly lower in elevation than that of the stationary platform G. It is this difference in the vertical spacing between the levels of the two platforms which determines the thickness of the slices of meat to be cut from the bulk meat items by the bandsaw C, as the carousel moves them past the bandsaw.

I will now describe the carousel which is indicated generally at M, in FIGS. 1, 2, 5, 6, 6A, 7, 8 and 9. The carousel has a central hub 37, see especially FIGS. 1, 7, 8 and 9. The inner cylindrical surface of the hub has longitudinally extending and diametrically opposed grooves 38 therein for receiving mating keys 39 that project outwardly from a drive shaft 40, see FIG. 8. The drive shaft has a reduced cylindrical and integral portion that has a sprocket 41 keyed thereto and a further reduced portion which is received in a thrust bearing 41 mounted in the upper horizontal portion of the upright 18. The drive shaft 40 is held against vertical displacement with respect to the horizontal portion of the upright 18 by a washer and a split ring, the washer being held against the thrust bearing 41' and the upright 18. It is obvious that drive shaft 40 could be supported on the upright 18 in any manner desired.

In FIG. 3, I illustrate how the drive shaft 40 for the carousel M is operatively connected to the electric motor F. The sprocket 41 is keyed to the shaft 40, see also FIGS. 7, 8 and 9, and a sprocket chain 42 connects the sprocket 41 to a drive sprocket 43 that is keyed to a vertically extending shaft 44. The lower end of the shaft 44 is connected to an air-controlled clutch 45. This air clutch is a manufactured item which is operated by air pressure working on a clutch disc, not shown. The clutch engages and connects the shaft 44 to a rotating shaft 46 when air pressure is applied to the clutch and releases when the air pressure is cut off. An air clutch control lever is schematically shown at 47 mounted on the control station 48, see FIGS. 1, 2 and 3 for controlling the operation of the air clutch 45.

The shaft 46 is rotated by a gear reduction mechanism housed within a casing 49 shown in FIG. 3 and supported by the upright 18. A variable driven pulley 50 is mounted on the shaft which drives the gear reduction mechanism 49 and an endless belt 51 interconnects the pulley 50 with a drive variable pulley 52 which in turn is mounted on the shaft for the motor F. An operation of the motor and the actuation of the air clutch 45 will cause the shaft 40 to be rotated at the desired speed for rotating the carousel M. The electric motor may be equipped with a speed control for causing the carousel to rotate at the desired speed.

Referring to FIGS. 5 and 7 to 9, inclusive, the details of the carousel M, are illustrated in these Figures. The central hub 37 is provided with a plurality of outwardly extending clevises 53 which are equally spaced about the hub. FIG. 7 shows five of these clevises and different hubs 37 could be substituted having different numbers of clevises, this depending upon the number of pairs of jaws required for engaging with the items of bulk meat L. Each clevis 53 has a socket 54 pivotally secured thereto at 55. It will be seen from FIGS. 8 and 9 that each clevis 53 has a base portion 56 that extends beyond the clevis and is provided with a transversely extending rib 57 and that each socket is U-shaped in cross section with the sides of the clevis abutting its associate base.

A plurality of arms N, are removable received in the sockets 54 and each arm is non-circular in cross section and is received in a similarly shaped non-circular recess in the socket so that the arm cannot rotate on its own longitudinal axis. Also in FIGS. 8 and 9, I illustrate each arm N, as having a transversely extending groove 58 on its undersurface that is designed to receive the rib 57 when the arm is inserted into the socket 54 and the groove 58 registers with the rib 57 when the socket is swung from its open position, shown in FIG. 9, into its closed position, as shown in FIG. 8. The socket 54 in cross section is in the shape of an inverted U, and its two side walls have recesses 59 in their lower edges which receive the adjacent portions of the rib 57 when the socket is in its closed position. In this manner the radially extending arms N, are removably secured in position and will be swung in a circle when the shaft 40 and the hub 37 are rotated.

I will now describe the meat-engaging pair of jaws which are carried by each arm N, see FIGS. 1, 2, 5 and 6. A bracket 60 is secured to each arm and supports a jaw P of the shape shown in FIGS. 5 and 6. The wall of the jaw extends vertically and it is shaped in horizontal cross section so as to partially enclose the bulk meat L. The top portion of the jaw is flared outwardly at 61' so as to guide the bulk meat L toward its proper position in the jaw interior when an operator feeds the bulk meat between the jaw P, and its cooperating spring-biased jaw Q which will now be described. The bottom of the bulk meat L will either rest upon the platform G, or the platform H, this depending upon the position of the arm N.

The spring-biased jaw Q, is designed to contact the bulk meat L, and yieldingly hold it in the jaw P while permitting the weight of the meat to bring the bottom of the meat into slidable contact with either one of the two platforms G and H. The jaw Q, is attached to one end of a lever 61 that in turn is pivoted at 62 to the arm N, see FIGS. 5 and 6. The other end of the lever 61 has a tension spring 63 attached thereto and the other end of the spring is connected to a bracket 64 mounted on the arm N. The tension exerted by the spring 63 on one end of the lever 61 will cause the lever to swing the jaw Q toward the jaw P, and thus yieldingly engage with the bulk meat L to move it over the surfaces of the two platforms G and H, while still permitting the weight of the bulk meat to cause the bottom of the meat to rest upon and slide over the platforms. The top of the spring-biased jaw Q, is outwardly flared at 65, as clearly shown in FIG. 6. The jaw Q, is held in a vertical position and it is angularly shaped in horizontal cross section. The outwardly flared tops 61 and 65 of the two cooperating jaws P, and Q act as a funnel to guide the bulk meat between the two jaws when the operator places the bulk meat above the outwardly flared portions and then lowers the meat until the bottom of the meat L rests upon the stationary platform G.

The carousel M rotates in a clockwise direction as indicated by the arrow 66 in FIG. 5. The operator places the bulk meat items L between the pairs of jaws P, and Q, as the arms N of the carousel M move clockwise over the stationary platform G. The adjustable platform H, has previously been adjusted vertically with respect to the stationary platform G, by operating the handle 29 on the control station 48. The schematic showing in FIG. 6A illustrates the vertical distance between the stationary platform G, and the adjustable platform H. This vertical spacing betwen the two platforms is also indicated at 67, in FIG. 2 as lying between the two horizontal double dash lines, the line 68 representing the top of the stationary platform G, and the line 69, representing the top of the adjustable platform H.

The schematic showing in FIG. 6A also shows the upper reach of the bandsaw blade C as lying in the same plane as the top of the stationary platform G. The pair of jaws P and Q have moved the bulk meat L over the adjustable platform H, in the direction of the arrow 70 until the portion of meat extending below the bottoms of the jaws comes into contact with the bandsaw blade. A slice 71 of meat is being cut from the bulk meat L. This action takes place after the bulk meat has been placed between a pair of jaws P and Q and the carousel arm N has swung clockwise in FIG. 5 to move the bulkmeat off from the stationary platform G and onto the adjustable platform H. At the edge 22 of the platform H, the bulkmeat is brought into contact with the saw blade C and a slice 71 of meat of the desired thickness is severed from the bulk meat L, and drops upon a downwardly inclined endless conveyor indicated generally at R, in FIG. 6A and also in FIGS. 1, 2 and 3. A bracket 72 connects the conveyor R to the main frame A.

When cutting T-bone steaks from bulk meat L, the bone edge 73 is preferably placed against the back of the jaw P. It is this jaw that withstands the thrust of the saw blade C, as it cuts a T-bone steak 71 from the meat. The bone 73 extends throughout the length of the bulk meat L and the saw blade C cuts the bone at right angles to its length. This assures that the slices 71 of meat will all be of uniform thickness. The endless conveyor R can deliver the meat slices into a receiving bin, not shown. If smaller cuts of meat are desired from the bulk meat, the carousel M may be changed to one having more radially extending arms N and pairs of jaws P and Q. The spring-biased jaw Q will automatically adjust to the size of the bulk meat L received between the two jaws.

The device can be started operating by pushing the starting switch 74 on the control station 48, see FIG. 1, and can be stopped by pushing the stop switch 75. This will start the bandsaw C operating. The rotation of the carousel M, is controlled by actuating the lever 47 on the control station 48 which in turn causes the air clutch 45, in FIG. 3, to operatively connect the motor F to the carousel M for causing the latter to rotate clockwise and successively move the bulk meat items L past the saw blade for cutting slices from the meat. The uniform movement of the pairs of meat-holding jaws P and Q past the cutting saw blade C will apply even and a constant pressure against the blade which will result in a uniform cut. It should be noted that the clockwise rotation of the carousel M, when looking at FIG. 5, will cause the jaws P to move the bulk meat items L over both platforms G, and H. I do not depend on the spring-biased jaws Q to move the bulk meat items. Their function is to merely yieldingly maintain the bulk meat items in the jaws P. The weight of the bulk meat items L, is sufficient to cause them to move downwardly between the jaws after each slice has been cut from the meat. At all times the platforms G, and H support the bulk meat items as they are moved thereover by the carousel.

My machine will eliminate the hand meat cutting from a bulk meat L. Better quality and more uniform cuts of meat will result. The cutting of meat by the machine will be far more rapid than can be accomplished by hand cutting. The two platforms G and H can be quickly removed from the machine for cleaning, sanitizing or for gaining access to the operating parts of the machine. A single motor F, is used for operating the bandsaw C as well as the carousel M. The carousel M may be hand operated if desired and this can be done when the air clutch 45 is disengaged. Broken or dull sawblades C can be quickly released by actuating the lever 15 and a new blade substituted. This machine will also be safe to operate. The hand will not come near the blade at all, as is the case when cutting the meat by hand.

I claim:

1. An automatic carousel-type meat cutting machine comprising:

a. a rotatable carousel having a central vertical drive shaft with a hub keyed to said shaft and a plurality of radially extending arms projecting from said hub and lying in a horizontal plane;

b. a pair of meat engaging jaws carried by each arm, one of the jaws in each pair being spring-biased, each pair of jaws adapted to receive a bulk meat item therebetween;

c. a circular meat supporting horizontal surface made up of an arcuate-shaped stationary platform with radially extending ends and a vertically adjustable arcuate-shaped platform with radially extending ends disposed close to the adjacent ends of the stationary platform;

d. means for rotating said drive shaft and carousel for moving said arms and pairs of jaws in a circular path for causing the bulk meat items to move over said platforms in a circular path while being slidably supported by said platforms;

e. means for mounting an endless bandsaw so that it has one of its two longitudinal reaches lying in a horizontal plane substantially parallel with the plane of said stationary platform and adjacent to one of its radial ends so that the teeth on the bandsaw will face away from the edge of this radial end;

f. means for lowering said adjustable platform below said stationary platform to a distance equal to the thickness of the slices of meat desired to be cut from the bulk meat items;

g. said carousel hub having a plurality of outwardly projecting clevises extending radially from the hub axis, each clevis extending radially from the hub axis, each clevis having a base portion that extends beyond the clevis;

h. a socket pivotally connected to each clevis and overlying its associate base, said socket being U-shaped in cross section with the sides of the socket normally facing downwardly and resting on its base; and i. each radially extending arm being removably received in said socket.

2. The combination as set forth in claim 1: and in which a. each clevis base has a transversely extending rib on its upper surface; and b. each radially extending carousel arm has a transversely extending groove adapted to receive said base rib when said arm is received in said socket;

c. whereby said arm is prevented from accidental removal from said socket but said arm can be removed when it is initially raised for swinging said socket upwardly and freeing the arm groove from said base rib.

3. An automatic carousel-type meat cutting machine comprising;

a. a rotatable carousel having a central hub removably keyed to a central drive shaft, said hub having a plurality of removable and radially extending arms projecting therefrom and lying in a horizontal plane;

b. a pair of vertically extending bulk meat-engaging jaws carried by each arm, one of the jaws in each pair being spring biased and swingable in a horizontal plane, each pair of jaws adapted to receive a bulk meat item therebetween and to accommodate automatically to the size of the item, the bone portion of the meat being disposed against the vertical surface of the non-spring biased jaw;

c. a circular meat supporting surface made up of an arcuate-shaped stationary platform with radially extending front and rear edges and a vertically adjustable arcuate-shaped platform with radially extending front and rear edges, the front edge of said adjustable platform being disposed close to the adjacent rear edge of the stationary platform and the front edge of the stationary platform being disposed close to the rear edge of the adjustable platform so that the bulk meat items will be supported by the platforms;

d. means for rotating the central drive shaft and carousel for moving said arms and pairs of jaws in a circular path;

e. means for lowering said adjustable platform below said stationary platform to a distance equal to the thickness of the slices of meat desired to be cut from the bulk meat items; and f. bulk meat cutting means disposed adjacent to the rear edge of the adjustable platform but on the same plane as the stationary platform for cutting meat slices from the bulk meat items as they are moved past said cutting means from the adjustable platform to the stationary platform.

4. A carousel comprising:

a. a hub having a plurality of outwardly projecting clevises extending radially from said hub axis, each clevis having a base portion extending beyond said clevis;

b. a socket pivotally connected to each clevis and overlying its associate base, said socket being U-shaped in cross section with the sides of the socket normally facing downwardly and resting on its base, each radially extending arm being removably receivable in said socket; and c. a pair of meat engaging jaws carried by each arm, one of the jaws in each pair being spring biased so as to be yieldingly urged toward its associate jaw.

5. The combination as set forth in claim 4 and in which a. each clevis base has a transversely extending rib on its upper surface;

b. each radially extending arm having a transversely extending groove adapted to receive said base rib when said arm is received in said socket;

c. whereby said arm is prevented from accidental removal from said socket, but said arm can be removed when it is initially raised for swinging said socket upwardly and freeing the arm groove from said base rib.

* * * * *